United States Patent [19]

Magee, Jr. et al.

[11] Patent Number: 4,638,860

[45] Date of Patent: Jan. 27, 1987

[54] APPARATUS FOR BLOCKING COMMUNICATION BETWEEN WELL BORE INTERVALS

[75] Inventors: Robert L. Magee, Jr., Fort Worth; Marvin B. Traweek, IV, Houston, both of Tex.

[73] Assignee: Arlington Automatics Inc., Grand Prairie, Tex.

[21] Appl. No.: 825,085

[22] Filed: Jan. 31, 1986

[51] Int. Cl.[4] ..... E21B 33/10

[52] U.S. Cl. ..... 166/114; 166/126

[58] Field of Search ..... 166/114, 116, 126, 128, 166/143, 145, 149, 150

[56] References Cited

U.S. PATENT DOCUMENTS 3,136,366 6/1964 Brown et al. ..... 166/114

3,559,732 2/1971 Tucker ..... 166/114

3,687,202 8/1972 Young et al. ..... 166/126 X

*Primary Examiner*—Stephen J. Novosad

*Assistant Examiner*—Thuy M. Bui

[57] ABSTRACT

In the representative embodiment of the apparatus of the invention disclosed herein, a packer plug is arranged with sealing means for closing off the central bore of the mandrel of a packer that is set in a well bore for selectively isolating upper and lower formation intervals. When the plug is set in the packer mandrel, collet fingers on the body of the new and improved plug for threadedly engaging internal threads in the upper end of the packer mandrel. To secure the plug against unwanted release, a retainer member is cooperatively secured to the plug mandrel by a shear pin which will fail only at a predetermined force.

11 Claims, 7 Drawing Figures

FIG. 5
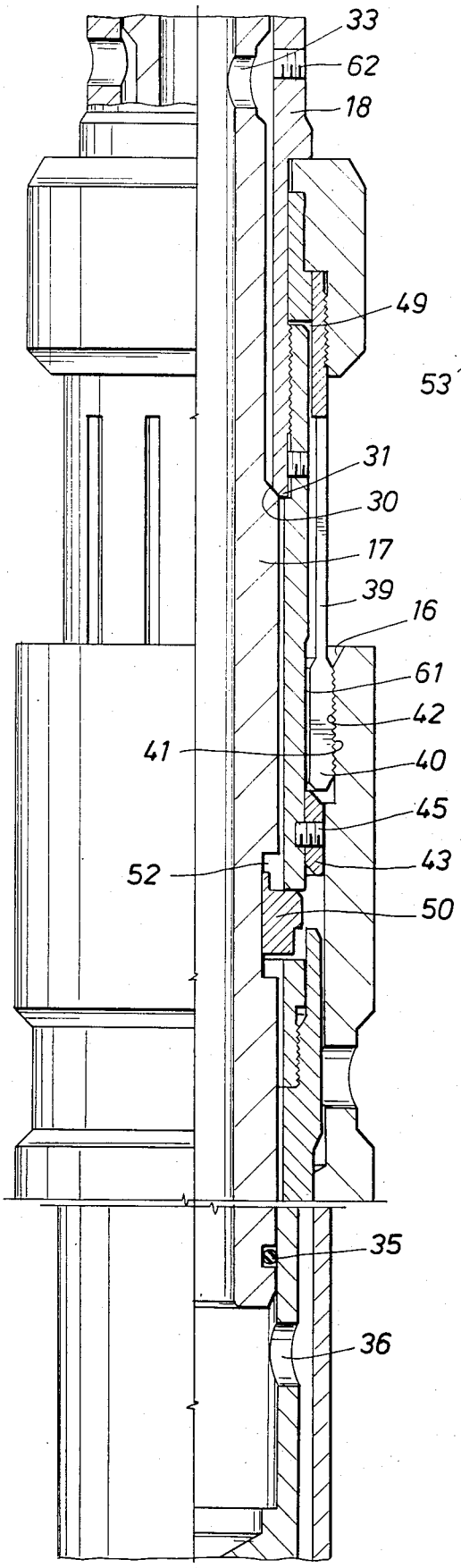
FIG. 3
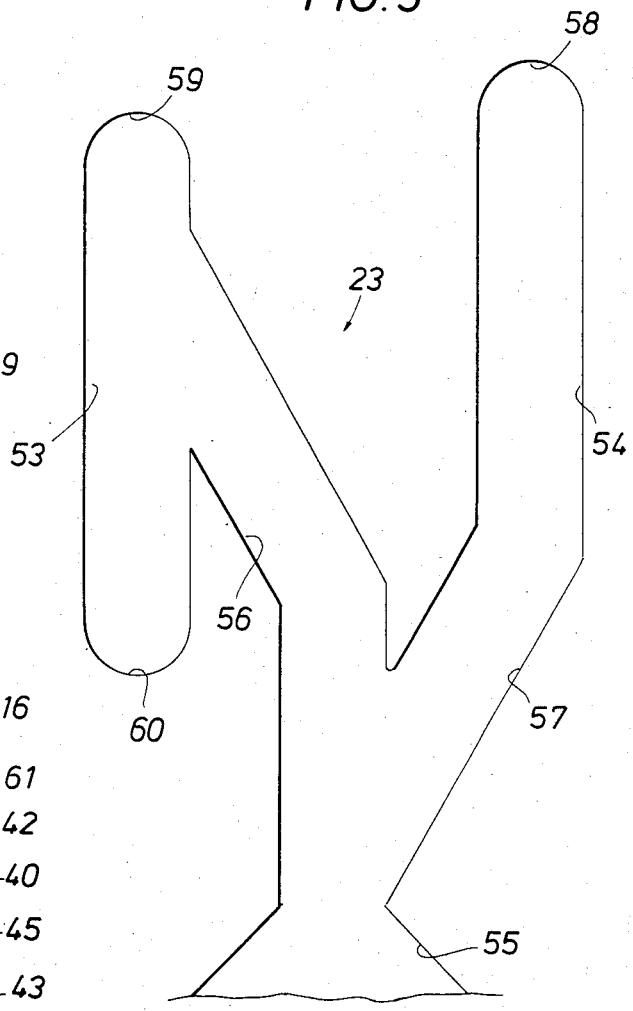
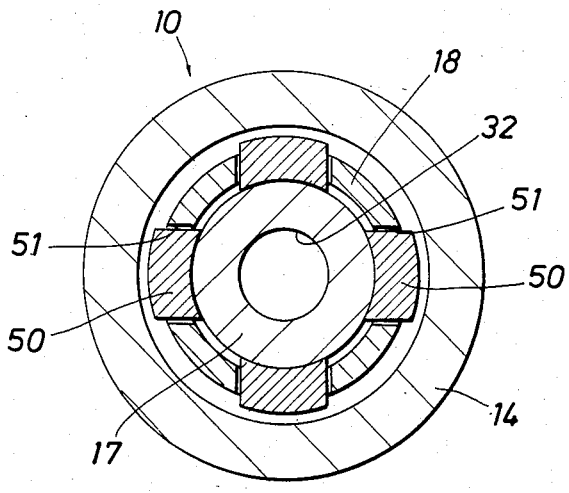
FIG. 4

APPARATUS FOR BLOCKING COMMUNICATION BETWEEN WELL BORE INTERVALS

BACKGROUND OF THE INVENTION

This invention relates to new and improved well bore apparatus for temporarily isolating a lower production interval from a higher production interval in a well bore. More particularly, this invention relates to new and improved methods and apparatus for temporarily blocking the mandrel of a packer set in a well bore between two producing intervals for closing communication through the packer mandrel and thereby isolating the lower interval while completion operations are conducted in the higher interval.

BACKGROUND ART

Those skilled in the art will, of course, recognize that when completion operations are conducted in a multi-interval well, it is usually preferred to isolate the interval being completed from the other intervals. Generally this isolation is achieved by setting a production packer between two intervals and temporarily inserting a so-called "packer plug" into an upwardly-facing socket cooperatively arranged in the upper end of the packer mandrel thereby blocking further communication through the mandrel. Once the completion operation is finished, the packer plug is retrieved and the lower end of a string of production tubing is then coupled into the socket to reopen communication between the surface and the lower interval.

The typical packer plug is comprised of an inner mandrel which is coaxially disposed within an outer housing and adapted for longitudinal movement therein between an initial lower position and a final upper position. An intermediate portion of the plug housing carries a stack of sealing members which are appropriately sized to be sealingly received within the lower portion of the socket in the packer mandrel. A plurality of resilient collet fingers are dependently mounted at spaced intervals around the upper portion of the housing and provided with externally-threaded enlarged heads on their lower ends arranged to threadedly engage internal threads in the upper portion of the socket and thereby releasably latch the packer plug within the socket. In many prior-art packer plugs, a group of wedge-shaped lugs are loosely mounted around the plug mandrel and initially positioned between an enlarged-diameter mandrel portion and the collet heads to retain the collet fingers in their outwardly-expanded position to maintain the threads engaged within the socket threads. Bypass communication through these prior-art packer plugs is controlled by valve means arranged on the plug mandrel for closing an axial fluid passage through the mandrel in the initial lower position of the mandrel and opening the passage upon movement of the mandrel to its upper position.

Once the production packer is set and before commencing a particular well-completion operation, a packer plug is run into the well on a suitable setting tool and latched to the packer by the threaded engagement of the collet fingers within the socket. It will be appreciated that so long as the plug mandrel is in its initial lower position, the retainer lugs prevent the collet fingers from retracting so that the packer plug will be securely anchored against upwardly-acting pressure forces that would otherwise move the packer plug out of the production packer.

To reopen communication with the lower packed-off well bore interval after the completion operation is finished, the running-in tool is again introduced into the well bore and recoupled to the packer plug. Then, with a typical packer plug, either by applying right-hand rotation or by pulling upwardly, a shear screw securing the plug mandrel to the housing is broken and the mandrel is shifted upwardly to open the bypass ports. Typically, upward movement of the plug mandrel to its upper position will cause the mandrel to be permanently secured in this position by means such as an outwardly-biased snap ring mounted around the mandrel which expands into an inwardly-opening housing groove so that the mandrel can not return to its initial lower position.

The upward movement of the plug mandrel is also adapted to release the collet fingers. Often this is accomplished by moving the enlarged mandrel portion above the several lugs and thereby allowing the lugs to move inwardly into the annular space immediately below the enlarged mandrel portion. Thus, once the plug mandrel is moved upwardly, there is nothing preventing the collet fingers from moving inwardly and only the frictional engagement of the co-engaged threads keeps the packer plug from being released from the production packer. Therefore, with these prior-art packer plugs, should there be an extreme upwardly-acting pressure force on the packer plug, the tension in the supporting pipe string may be sufficiently reduced to put the pipe string into compression. Since the plug mandrel cannot be returned to its initial position, the bypass valve can not be reclosed and the operator has no alternative but to bring the packer plug out of the well regardless of the adverse pressure conditions.

OBJECTS OF THE INVENTION

Accordingly, it is an object of the present invention to provide new and improved apparatus for temporarily isolating a lower well bore interval while completion operations are carried out in a higher well bore interval.

It is a further object of the present invention to provide a new and improved packer plug which is cooperatively arranged to be seated and securely anchored in a well packer for temporarily isolating a lower well bore interval and thereafter released only by selectively manipulating a running-in tool coupled to the plug.

SUMMARY OF THE INVENTION

These and other objects of the present invention are attained by providing a new and improved packer plug that is adapted to be coupled to a running-in tool and lowered into a well bore until the packer plug is securely latched and sealingly engaged within an internally-threaded socket provided in the upper end of a packer which was previously set in the well bore between upper and lower intervals. The new and improved packer plug includes an inner member arranged within an outer member to be moved relative thereto between an initial lower position and a final upper position. Sealing means are cooperatively mounted on an intermediate portion of the outer member to be sealingly engaged within the socket on the packer body. Normally-closed bypass means are provided to open fluid communication between the upper and lower well bore intervals as the inner member is moved to its final upper position. Latching means on the outer member include a plurality of depending flexible collet fingers having outwardly-threaded enlarged heads cooperatively arranged to threadedly engage the threads in the socket when the packer plug is inserted therein. To control the disengagement of the collet fingers from the socket threads, the latching means further include a retaining member which is selectively coupled to the plug mandrel and cooperatively positioned for maintaining the enlarged heads on the collet fingers threadedly engaged within the socket until a force of at least a predetermined magnitude is applied to the plug mandrel for releasing the retaining member for movement away from its initial retaining position.

BRIEF DESCRIPTION OF THE DRAWINGS

The novel features of the present invention are set forth with particularity in the appended claims. The invention, together with further objects and advantages thereof, may best be understood by way of illustration of the following description of exemplary apparatus employing the principles of the present invention as illustrated in the accompanying drawings, in which:

FIG. 3 is a somewhat-schematic representation of a particular design detail of the packer plug;

FIG. 4 is a transverse cross-sectional view taken along the line 4—4 of FIG. 2B; and FIG. 5 is an elevational view showing the upper and lower portions of the packer plug of the invention and depicts its final operating position.

DESCRIPTION OF A PREFERRED EMBODIMENT

Figure 1:
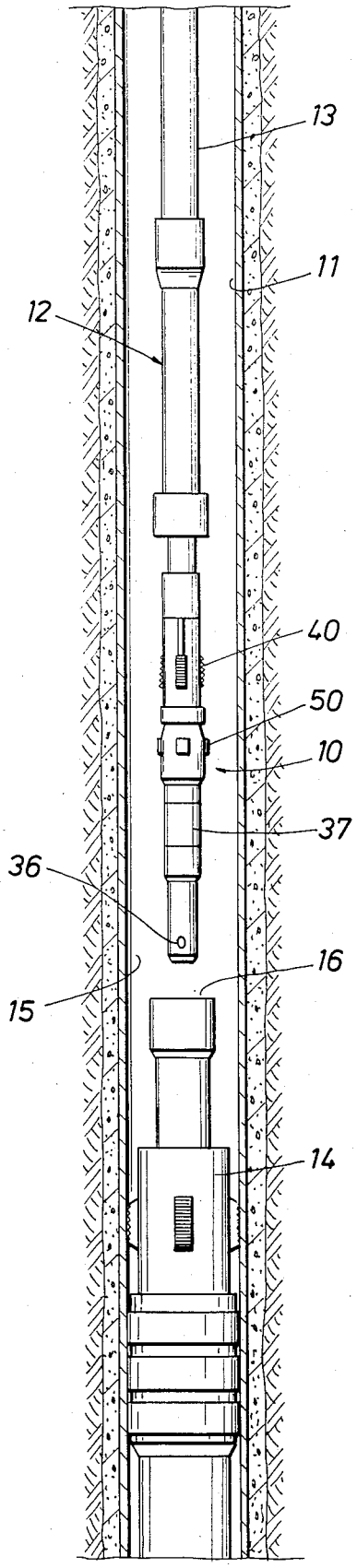
FIG. 1 shows a preferred embodiment of the apparatus of the present invention as it is used for temporarily blocking communication between upper and lower intervals of a production well in which a typical packer has been set to isolate these intervals.

Turning now to FIG. 1, a new and improved packer plug 10 of the present invention is shown as it is being lowered in a cased production well 11 by means such as a suitable running-in tool 12 dependently coupled to a tubing string 13. In keeping with the objects of the invention, the new and improved packer plug 10 is depicted as it is being inserted into the upper end of a typical packer 14 to temporarily close fluid communication through the packer and thereby isolate one or more of the lower intervals of the well bore 11 while completion operations are carried out in the upper well bore interval as shown generally at 15. As is typical, the packer 14 was previously set in the well bore 11 to isolate the lower interval from the depicted upper interval 15. Where, for instance, the packer 14 is a typical gravel-pack packer, a suitable gravel screen (not seen in the drawings) is dependently coupled therebelow and the upper end of the packer is cooperatively arranged to provide an upwardly-facing, internally-threaded socket, as at 16, into which the lower end of a string of production tubing, a pump, or other well-completion devices can be coupled and thereby be in fluid communication with the packed-off interval therebelow. It will, of course, be appreciated that for purposes of practicing the present invention, the packer 14 can be any conventional packer.

Figure 2A:
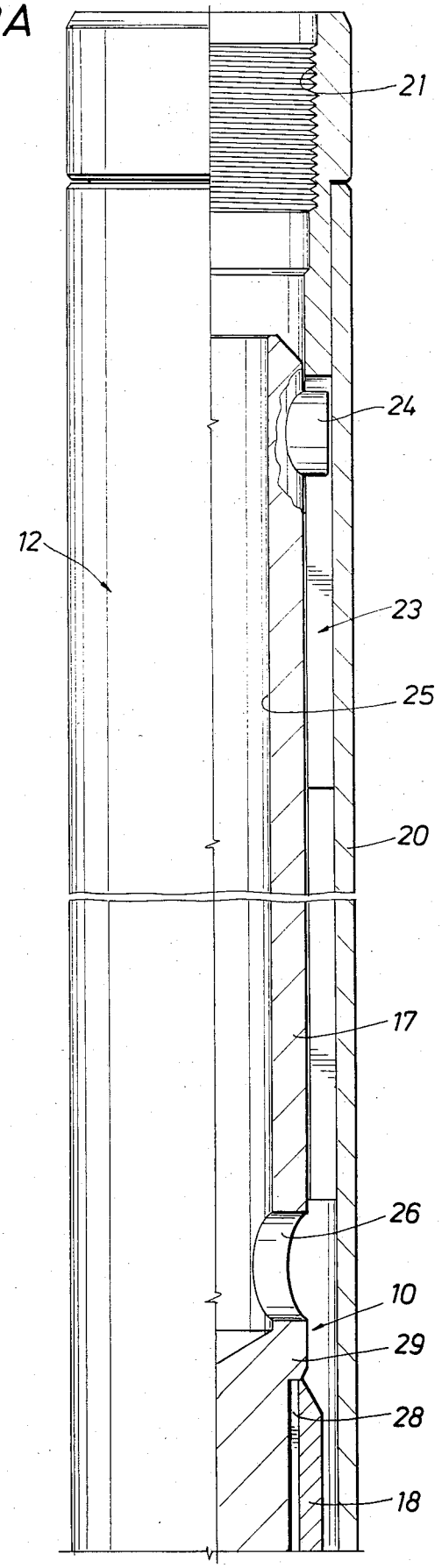
FIGS. 2A–2C are successive elevational views, partially in cross-section, depicting the initial operating position of a preferred embodiment of a new and improved packer plug incorporating the principles of the present invention.
Figure 2B:
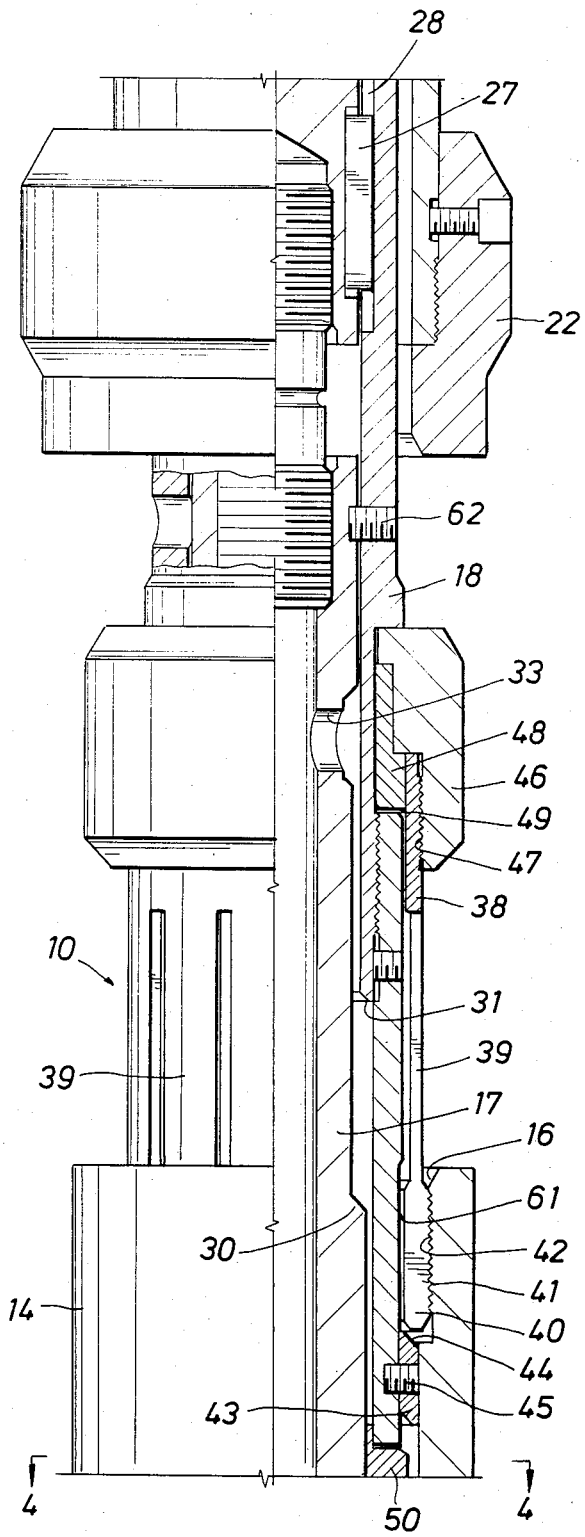
Figure 2C:
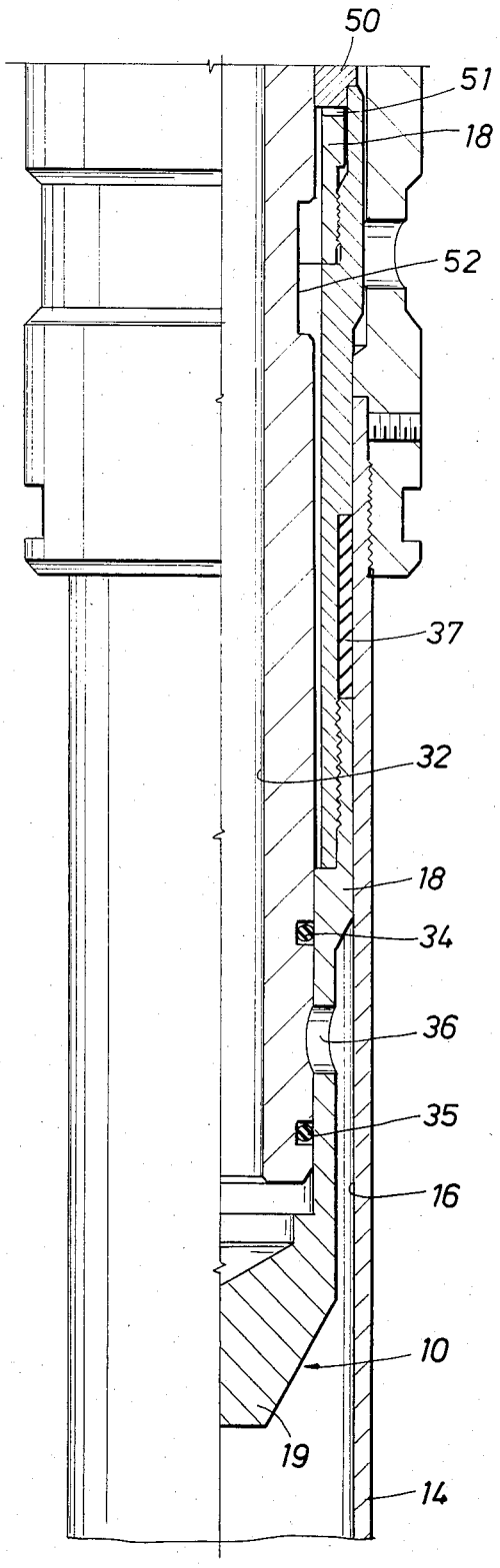

Turning now to FIGS. 2A–2C, successive elevational views, partially in cross-section, are shown of the packer plug 10 of the present invention as it will appear when it has been inserted into the packer 14 and before the running-in tool 12 has been removed. From these successive views it will be seen that the packer plug 10 of the present invention includes an elongated mandrel 17 that is coaxially arranged within an elongated tubular housing 18 that is closed at its lower end by a suitable end piece 19. Those skilled in the art will, of course, appreciate that to simplify the fabrication, assembly and maintenance of the packer plug 10, the mandrel 17 and the housing 18 are necessarily comprised of several interconnected sub-assemblies or individual components. However, to facilitate the following description of the plug 10, the interconnected sub-assemblies of the mandrel and the housing are simply designated by their respective numerals 17 and 18.

As seen in FIGS. 2A and 2B, the setting or running-in tool 12 is comprises of a tubular housing 20 having means, such as a standard coupling with internal threads 21, cooperatively arranged for coupling the running-in tool to the lower end of a string of pipe as at 13. If desired, a standard gage ring, as at 22, may be coupled to the lower end of the housing 20 of the tool 12. As will subsequently be described in detail by reference to FIGS. 3 and 5, the packer plug 10 is releasably coupled to the running-in tool 12 by indexing means such as a typical system 23 of interconnected inwardly-opening grooves cooperatively arranged in the internal wall of the tubular housing 20 for receiving an outwardly-projecting guide pin 24 mounted on the upper end of the plug mandrel 17.

In the preferred embodiment of the packer plug 10, a short axial bore 25 in the upper end of the plug mandrel 17 is terminated just below one or more lateral ports, as at 26, to allow fluids to be pumped through the pipe string 13 and around the upper end of the plug mandrel should it be necessary to wash away sediment or well bore detritus before the running-in tool 12 is recoupled to the plug mandrel.

From FIGS. 2A and 2B it will be seen that a lateral key or pin 27 which is mounted on the intermediate portion of the mandrel 17 and slidably disposed within an inwardly-opening longitudinal groove 28 in the upper portion of the housing 18 secures the plug mandrel against rotation with respect to the plug housing. From these same two figures it will be seen that the lower operating position of the mandrel 17 is established by the engagement of a shoulder, as at 29, on the mandrel against the upper end of the plug housing 18. Similarly, it will also be seen that the mandrel 17 will reach its upper operating position when an upwardly-facing shoulder 30 on the intermediate portion of the mandrel engages the lower face of an internal shoulder 31 in the intermediate portion of the housing 18.

In the preferred manner of providing a bypass passage through the packer plug 10, as seen in FIGS. 2B and 2C an axial bore 32 in the lower portion of the mandrel 17 is terminated at its upper end by one or more lateral ports 33. To selectively control communication through the axial bore 32, valve means are provided by arranging a spaced pair of O-rings 34 and 35 around the lower end of the mandrel 17 which will straddle one or more lateral ports, as at 36, in the lower end piece 19 of the hplug housing 18 and thereby close these ports so long as the mandrel remains in its illustrated lower operating position.

Although different types of typical packing elements can, of course, be employed, in the preferred arrangement of the packer plug 10 an integral elastomeric member 37 is securely bonded to a lower portion of the plug housing 18 above the ports 36. It will, of course, be appreciated that the external diameter of the seal 37 is appropriately sized to sealingly engage the internal wall of either the upwardly-facing packer socket 16 or a tubular extension thereof as at XX.

To securely anchor the packer plug 10 in the packer 14, as seen in FIG. 2B a typical collet sleeve 38 is longitudinally slotted at equally-spaced intervals to provide a plurality of depending flexible fingers, as at 39, with outwardly-enlarged heads as at 40. By mounting the sleeve 38 around the upper portion of the plug housing 18 with the fingers 39 in this position, the flexibility of the fingers will cooperatively engage external threads, as at 41, on the enlarged heads 40 with complemental internal threads 42 within the socket as the packer plug 10 is moved into the socket 16.

In keeping with the objects of the present invention, the packer plug 10 is particularly arranged to include new and improved anchor-retaining means such as a ring 43 having a tapered upper face 44 which is loosely mounted around the upper portion of the plug housing 18 and releasably secured thereto by means such as a stout pin or screw 45 calculated to fail when an upwardly-directed force of at least a predetermined magnitude is applied to the plug mandrel 17. The packer plug 10 is also uniquely arranged to allow limited longitudinal movement of the housing 18 in relation to the collet member 38. In the preferred manner of achieving this limited relative movement, the collet member 38 is coupled to an large nut 46 by means such as threads 47; and the nut is disposed over a tubular spacer 48 that is slidably mounted around a reduced-diameter portion of the plug housing 18. To control the distance that the nut 46 can move in relation to the plug housing 18, the length of the spacer 48 is designed to leave a narrow gap, as at 49, between the spacer and the adjacent shoulder of the housing 18. For reasons which will subsequently be explained, this gap 49 must be at least equal to, if not slightly greater than, the longitudinal spacing between the bevelled surface 44 on the retainer ring 43 and the lower ends of the enlarged collet heads 40.

As is typical, the packer plug 10 is also designed to lock the mandrel 17 in its final elevated operating position once it has been moved upwardly from the lower position illustrated in FIGS. 2A–2C. In the preferred manner of providing mandrel-locking means for achieving this, as seen in these figures as well as in FIG. 4 one or more lugs, as at 50, are loosely disposed in a corresponding number of openings 51 which are circumferentially spaced around the intermediate portion of the plug housing 18. A reduced-diameter portion 52 of the mandrel 17 is cooperatively arranged to be positioned below the lugs 50 so long as the plug mandrel is in its depicted lower operating position. As will subsequently be described in more detail by reference to FIG. 5, this reduced-diameter mandrel portion 52 is appropriately situated and sized so as to partially receive the lugs 50 when the mandrel 17 is moved upwardly to its final operating position.

Turning now to FIG. 3, the interconnected system 23 of grooves is shown in a somewhat-schematic representation. As depicted, the system 23 is comprised of two angularly-separated longitudinal inwardly-facing grooves 53 and 54 within the upper portion of the tubular housing 20 of the running-in tool 12. To permit the guide pin 24 to enter the system 23 of grooves, an upwardly-converging groove 55 is positioned in the lower portion of the tubular housing 20 and extended upwardly where it is divided into a first branch groove 56 leading to the mid-portion of the longitudinal groove 53 and a second branch groove 57 that opens into the lower end of the other longitudinal groove 54.

Those skilled in the art will, of course, recognize that with this typical groove system 23, the running-in tool 12 can be appropriately manipulated for controlling the packer plug 10. Accordingly, when the packer plug 10 is to be moved into the well bore 11 and inserted into the packer 14, the guide pin 24 is positioned within the longitudinal groove 54. Thus, so long as the guide pin 24 is in the groove 54, a downward movement of the running-in tool 12 will position the upper shoulder 58 in the groove 54 against the guide pin and thereby apply a downward force against the plug mandrel 17. Conversely, upward movement of the running-in tool 12 will raise the tubular housing 20 and thereby cause first the groove 57 ot move over the guide pin 24 and then the downwardly-diverging groove 55 until the housing 20 is freed from the plug mandrel 17. In a similar fashion, by virtue of the groove system 23, when the running-in tool 12 is to be recoupled to the packer plug 10, the running-in tool is simply lowered over the upstanding end of the plug mandrel 17 so as to reposition the upwardly-converging groove 55 over the guide pin 24. Then, as the running-in tool is lowered into position over the plug mandrel 17, the groove 56 will direct the guide pin 24 into the groove 53 where the guide pin will be confined between the opposed shoulders 59 and 60 defined at the opposite ends of the groove 53.

PRACTICE OF THE INVENTION

To practice the present invention, the new and improved packer plug 10 is coupled to the running-in tool 12 by the interengagement of the guide pin 24 within the system of grooves 23 as described above. The plug 10 is then lowered into the well bore 11 by means of the string of pipe 13 and landed in the upstanding socket 16 in the packer 14. As depicted in FIGS. 2A–2C, once the packer plug 10 is moved into the socket 16, the sealing member 37 will be sealingly engaged within the lower portion of the socket 16 and thereby close fluid communication through the packer 14. At the same time, as the packer plug 10 is moved into the socket 16, by virtue of the slight annular clearance space 61 between the housing 18 and the backside of the enlarged heads 40 on the lower ends of the collet fingers 39 the collet fingers will be free to flex sufficiently to allow the threads 41 to ratchet into the socket threads 42. The threads 41 and 42 will, therefore, be co-engaged to secure the packer plug 10 in the socket 16 once the mandrel shoulder 29 comes to rest on top of the housing 18. As previously discussed by reference to FIG. 3, once the packer plug 10 is positioned, the tubing string 13 is appropriately manipulated to free the running-in tool 12 from the plug mandrel 17 and return the running-in tool to the surface.

Once the packer plug 10 is anchored and sealed within the socket 16 it will be recognized that the engagement of the mandrel shoulder 29 with the upper end of the plug housing 18 will support the plug against any downwardly-acting pressure forces. On the other hand, should there be an upwardly-acting pressure force on the packer plug 10, it will be recognized from FIGS. 2B and 2C that by virtue of the clearance space 49 between the spacer 48 and the plug housing 18, the housing will be moved upwardly until the upper face 44 of the retainer ring 43 is abutted with the opposed surfaces on the lower ends of the enlarged collet heads 40. It will be seen that once the surface 44 is abutted with the collet heads 40, any upwardly-directed pressure force will be effectively supported by the co-engaged threads 41 and 42. As previously mentioned, the shear pin 45 is appropriately sized to withstand any anticipated pressure force.

Once the completion operations in the upper well bore interval 15 have been completed and it is desired to re-open fluid communication with the lower interval below the packer 14, the running-in tool 12 is again lowered into the well bore 11 on the pipe string 13. As described above, the running-in tool 12 is lowered over the upstanding mandrel 17 of the packer plug 10 until the guide pin 24 is confined within the groove 53. In this position, an upward force or a rotational force can be applied to the plug mandrel 17 by virtue of the co-engagement of the guide pin 24 with the vertical walls of the groove 53 and the lower end surface 59 of the groove.

Accordingly, when it is desired to retrieve the packer plug 10, the plug mandrel 17 is first moved upwardly to open the lateral port 36. It should be noted that, if it is employed to secure the mandrel 17 to the housing 18, a relatively-weak shear pin 62 is first broken either by applying torque to the mandrel or by applying an upward force to the mandrel. It should be noted that it the shear pin 62 is utilized, it is considerably weaker than the pin 45 securing the retainer ring 43 to the housing 18.

Once the mandrel 17 is moved upwardly, it will be recognized from FIG. 5 that the lower O-ring 35 will have been elevated above the lateral port 36 thereby re-opening fluid communication through the packer 14 to the well bore interval therebelow. It will also be recognized from FIG. 5 that the upward travel of the mandrel 17 will position the reduced-diameter mandrel portion 52 behind the lugs 50 thereby allowing the rear portions of these lugs to move into this recess leaving their forward portions still disposed in the openings 51 in the housing 18. It will be appreciated that once the lugs 50 are bridging the gap between the mandrel 17 and the housing 18, the mandrel can not again be moved either upwardly or downwardly. In this manner, with the lugs 50 locking the mandrel 17 in its elevated operating position, the well bore interval below the packer 14 will be communicated with the upper interval 15.

Once the mandrel 17 is in its elevated position as shown in FIG. 5, the new and improved packer plug 10 will still be securely anchored in the socket 16 of the well packer 14. Those skilled in the art will, of course, recognize that with the new and improved packer plug 10 this distinctive feature is provided by the unique coupling of the retainer member 43 to the housing 18 that is provided by the pin 45. With the mandrel 17 in its elevated position, any upwardly-directed pressure force on the packer plug 10 will be supported only by the co-engagement of the bevelled surfaces 44 of the retainer member 43 against the lower ends of the enlarged collet heads 40 which is transferred to the co-engaged threads 41 and 42. This will, of course, require that the shear pin 45 be designed to withstand such pressure forces. Thus, in keeping with the objects of the present invention, an extreme pressure differential between the upper and lower intervals in the well bore 11 will not be a hazard as with prior-art packer plugs which require the operator to remove the plug regardless of the pressure differential. With the packer plug 10 of the present invention, the operator instead can simply wait until such time that the pressure differential has been reduced to a lower level which will allow the packer plug to be retrieved without risk.

By virtue of the shear pin 45 it will be appreciated that an upward or rotational force must be applied to the tubing string which is sufficent to fail that pin. Once this is done, there is, of course, no difficulty in removing the packer plug 10 since the enlarged collet heads 40 can again retract into the annular space 61 sufficiently to allow the collet threads 41 to be disengaged from the socket threads 42.

Accordingly, it will be appreciated that the present invention has provided a new and improved packer plug which can be securely anchored in a well packer. By arranging the plug to be disengaged only by applying a force of at least a predetermined magnitude on the tubing string coupled to the plug, the plug will not be disengaged when there is an unexpected increase in the pressure forces acting on the plug. Moreover, in utilizing the new and improved plug of the present invention, extreme pressure differentials can be controlled without potential hazard.

While only a particular embodiment of the present invention has been shown and described, it is apparent that various changes and modifications may be made without departing from this invention in its broader aspects; and, therefore, the aim in the appended claims is to cover all such changes and modifications as fall within the true spirit and scope of this invention.

We claim:

1. Apparatus adapted to be moved into the upwardly-opening axial bore of a central member of a packer anchored in a well bore for selectively closing communication between formation intervals above and below the packer and comprising:

a tubular body adapted to be telescopically disposed within an internally-threaded upper bore portion and a smooth-wall lower bore portion in the central packer member;

seal means on said body for sealingly engaging the smooth-wall bore to block communication therethrough around said body;

a mandrel telescopically arranged within said body and adapted for longitudinal movement between upper and lower positions;

bypass means cooperatively arranged for closing communication through said body in one position of said mandrel and for opening said communication in the other position and said mandrel;

latching means including a plurality of flexible collet fingers dependently secured around said body having externally-threaded enlarged heads cooperatively arranged for threadedly engaging the internally-threaded bore portion to anchor said body within the the central packer member; and retaining means including a retaining member cooperatively mounted on said mandrel and movable against said collet fingers in response to upward movement of said mandrel for threadedly engaging said enlarged heads within the internally-threaded bore portion, and means normally securing said retainer member to said mandrel and operable only in response to a force on said mandrel of at least a predetermined magnitude to release said retainer member for movement away from said enlarged heads.

2. The apparatus of claim 1 wherein said bypass means include a fluid passage through said mandrel, a port in said body, and seal means arranged between said body and said mandrel for closing communication between said fluid passage and said port when said mandrel is in its said one position and for opening communication between said fluid passage and said port when said mandrel is in its said other position.

3. The apparatus of claim 2 wherein said one mandrel position is its said lower position and said other mandrel position is its said upper position.

4. The apparatus of claim 1 further including means between said mandrel and said body cooperatively arranged for securing said mandrel in its said other position.

5. The apparatus of claim 4 wherein said one mandrel position is its said lower position and said other mandrel position is its said upper position.

6. The apparatus of claim 1 wherein said retaining member and said enlarged heads are respectively provided with complemental inclined surfaces cooperatively arranged so that said upward movement of said mandrel will urge said enlarged heads outwardly into threaded engagement with the internally-threaded bore portion of the central packer member.

7. The apparatus of claim 1 wherein said bypass means include a fluid passage in said mandrel, a port in said body, and seal means between said body and said mandrel cooperative for closing communication between said fluid passage and said port when said mandrel is in said lower position and for opening communication between said fluid passage and said port when said mandrel is in said upper position; and further including means normally securing said mandrel from moving relative to said body and responsive to a force less than said predetermined magnitude for releasing said mandrel for longitudinal movement between its said upper and lower positions.

8. The apparatus of claim 7 wherein said retaining member and said enlarged heads are respectively provided with complemental inclined surfaces cooperatively arranged so that said upward movement of said mandrel will urge said enlarged heads outwardly into threaded engagement with the internally-threaded bore portion of the central packer member.

9. Apparatus adapted for selectively closing communication between spaced formation intervals penetrated by a cased well bore and comprising:

packer means cooperatively arranged to be set in a cased well bore for isolating upper and lower formation intervals and including a central member with an axial passage therethrough providing communication between the upper and lower ends thereof, said axial passage having an upper internally-threaded bore portion and a lower smooth-walled bore portion therein;

plug means cooperatively arranged to be suspended from a pipe string and lowered in a well bore and including a tubular body adapted to be received within said upper and lower bore portions, seal means positioned on a lower portion of said tubular body for sealingly engaging said smooth-walled bore portion within said central packer member, a mandrel telescopically arranged within said tubular body for longitudinal movement between spaced upper and lower positions, and bypass means responsive to movement of said mandrel for closing communication through tubular body when said mandrel is in its said lower position and for opening communication through said tubular body when said mandrel is in its said lower position; and means for releasably latching said plug means within said central means including a plurality of flexible depending collet fingers secured around an upper portion of said tubular body and having externally-threaded heads engaged in said internally-threaded bore portion, a collet retainer on said mandrel and movable against said externally-threaded heads in response to upward movement of said mandrel for firmly engaging said externally-threaded heads within said internally-threaded bore portion, and means releasably securing said collet retainer to said mandrel and releasable only in response to a force on said mandrel of at least a predetermined magnitude to release said collet retainer from said mandrel to allow said collet fingers to contract sufficiently to disengage said externally-threaded heads from within said internally-threaded bore portion.

10. The apparatus of claim 9 further including means between said mandrel and said tubular body cooperatively arranged for securing said mandrel in its said lower position and operable in response to a force less than said predetermined magnitude to release said mandrel for movement relative to said tubular body.

11. The apparatus of claim 9 wherein said collet retainer and said externally-threaded heads are respectively provided with complemental inclined surfaces cooperatively arranged so that upward movement of said mandrel will urge said externally-threaded heads outwardly into firm threaded engagement with said internally-threaded bore portion.

* * * * *